United States Patent [19]

Thompson

[11] Patent Number: 5,011,382

[45] Date of Patent: Apr. 30, 1991

[54] RECIPROCATING PISTON PUMP

[76] Inventor: George A. Thompson, 114 Demotte Ave., Daytona Beach, Fla. 32019

[21] Appl. No.: 301,551

[22] Filed: Jan. 26, 1989

[51] Int. Cl.[5] ..... F04B 39/14

[52] U.S. Cl. ..... 417/571; 92/170.1; 92/169.1

[58] Field of Search ..... 417/415, 571, DIG. 1; 92/169.1, 169.2, 170.1

[56] References Cited

U.S. PATENT DOCUMENTS

| | | | |
|---|---|---|---|
| 1,476,794 | 12/1923 | Berry | 417/571 |
| 2,176,691 | 10/1939 | Simons | 417/571 |
| 2,710,137 | 6/1955 | Arnouil | 92/154 |
| 3,084,717 | 4/1963 | Purcell | 92/170.1 |
| 3,716,310 | 2/1973 | Guenther | 92/172 |
| 3,994,208 | 11/1976 | Boyes | 92/240 |
| 4,207,807 | 6/1980 | Takata et al. | 92/170.1 |
| 4,449,446 | 5/1984 | Degnen et al. | 92/171.1 |
| 4,776,776 | 10/1988 | Jones | 417/571 |

*Primary Examiner*—Leonard E. Smith
*Assistant Examiner*—Robert N. Blackmon
*Attorney, Agent, or Firm*—Sughrue, Mion, Zinn, Macpeak & Seas

[57] ABSTRACT

A reciprocating pump is provided with a flexible resilient cylinder which is mounted under tension between two end caps. The end caps are adjustably interconnected by means of a plurality of staybolts whereby the longitudinal tension on the cylinder may be adjusted. A piston comprised of a spherical segment is mounted for reciprocation within the cylinder with the spherical surface of the piston disposed in sliding contact with the cylinder.

4 Claims, 1 Drawing Sheet

RECIPROCATING PISTON PUMP

BACKGROUND OF THE INVENTION

The present invention is directed to a reciprocating piston pump more specifically to a reciprocating pump having a piston comprised of a spherical segment reciprocating within a flexible cylinder.

The use of a piston in a reciprocating piston pump wherein the piston is a segment of a sphere is old and well known as evidenced by the U.S. Pat. Nos. 2,710,137 and 3,716,310. Such a configuration enables the piston to be in engagement With the chamber Wall of the cylinder even in the most tilted positions of the pitman relevant to the cylinder axis. The cylinders in both of these patents are constructed of a hard rigid material Guenther teaches the use of an annular ring of soft pliable material about the convex parameter of the piston but does not provide any means for adjusting the diameter of the annular ring to accommodate wear.

The U.S. Pat. No. 4,449,446 is directed to a ballistically tolerant control system for a cylinder-piston assembly wherein the piston is controllably positioned within the cylinder which is provided with a deformable sleeve so that when the cylinder is deformed by sharp impact the piston can still continue to reciprocate within the cylinder due the the deformation, either due to frangibility or softness, of the sleeve.

In the construction of prior art pumps it is old and well known as evidenced by the U.S. Pat. No. 1,610,174 to locate the cylinder between a pair of opposed heads which are interconnected by a plurality of tension rods located externally of the cylinder about the circumference thereof. Thus, the rigid cylinder is clamped between the opposed heads.

SUMMARY OF THE INVENTION

The present invention provides a new and improved reciprocating piston pump comprised of a piston formed from a segment of a sphere which is mounted for reciprocating movement within a cylinder constructed of flexible resilient material to provide a fluid tight adjustable sealing arrangement between the piston and cylinder without the need for sealing rings between the piston and cylinder. The piston may be constructed of bronze and the cylinder may be constructed of flexible polyurethane which is mounted under tension lengthwise of the cylinder by means of adjustable bolts extending between two end caps which in turn are connected to opposite ends of the cylinder. The diameter of the piston is equal to or slightly greater than the internal diameter of the flexible cylinder to provide the necessary sealing engagement and after a period of time the tension may be increased on the cylinder to compensate for any wear which has occurred. The piston may be reciprocated by a motor driven piston rod and a pair of one way flap valves are provided in inlet and outlet passages located in one of the end caps.

The foregoing and other objects features and advantages of the invention will be apparent from the following more particular description of a preferred embodiment of the invention as illustrated in the accompanying drawings.

DETAILED DESCRIPTION OF THE INVENTION

Figure 1:
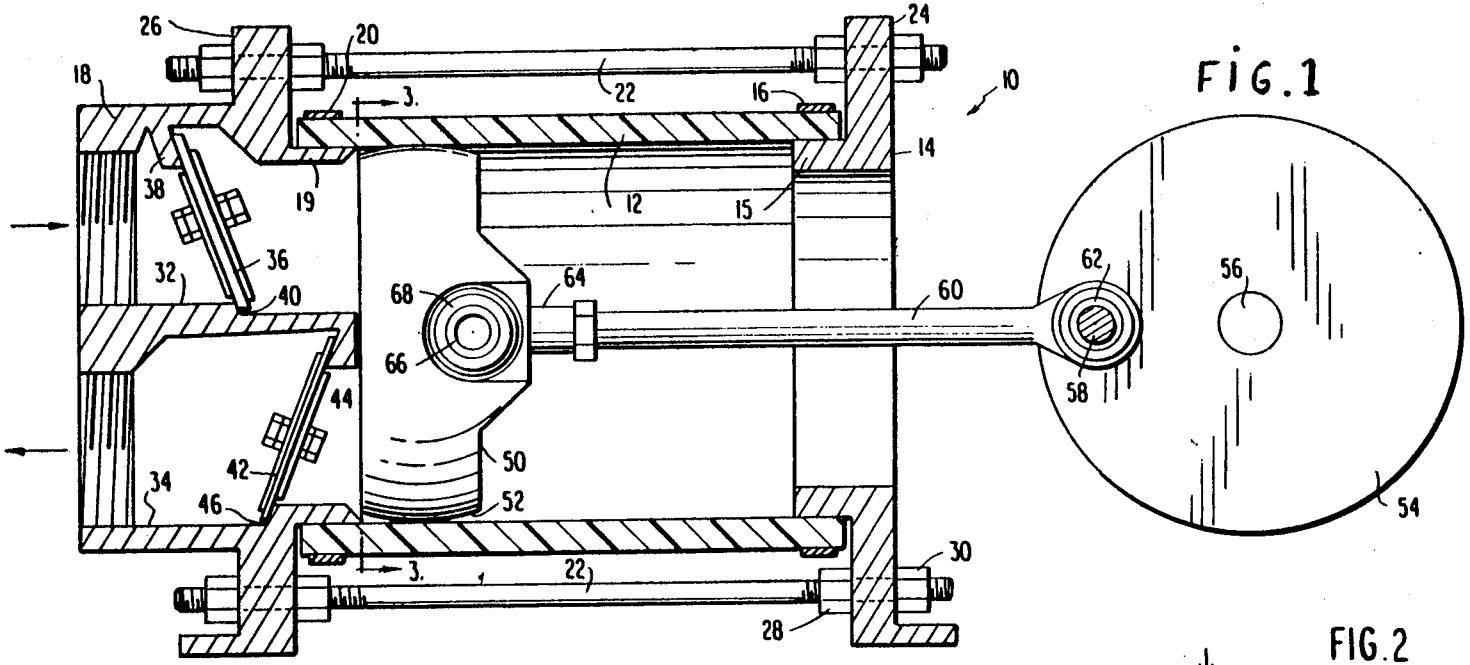
FIG. 1 is a longitudinal sectional view of the reciprocating piston pump according to the present invention taken along the line 2—2 of FIG. 2.
Figure 2:
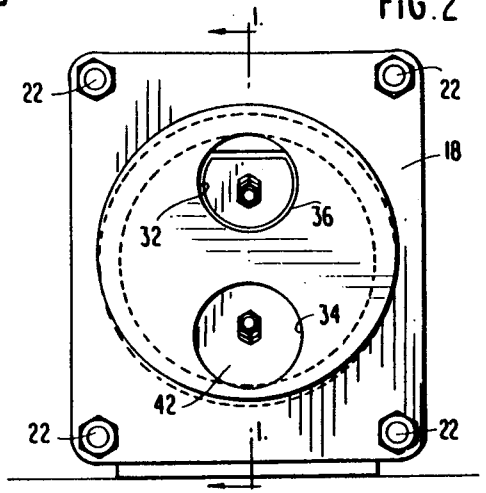
FIG. 2 is an end view of the pump assembly shown in FIG. 1 as viewed from the left end thereof
Figure 3:
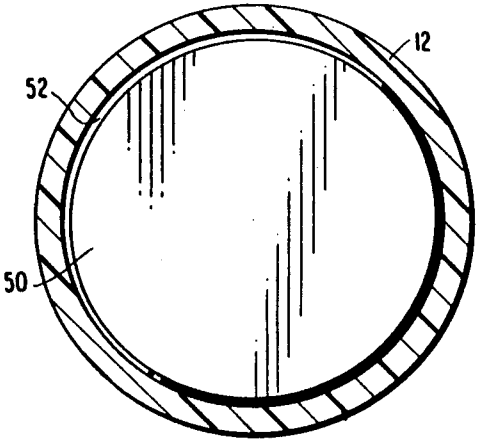
FIG. 3 is a sectional view taken along the line 3—3 in FIG. 1.

The reciprocating piston pump 10 according to the present invention is comprised of a flexible resilient cylinder 12 which is connected at one end to a cylindrical hub 15 of an end cap 14 by means of a suitable fastener 16. The opposite end of the cylinder 12 is connected to a second end cap 18 by means of a suitable fastener 20. The end caps are interconnected by means of 4 equally spaced apart staybolts 22 which extend between flanges 24 and 26 on the end caps 14 and 18, respectively, and which are connected thereto by a pair of nuts 28 and 30 which are threaded on the ends of the staybolts on opposite sides of the flanges.

The end cap 18 is provided with an inlet passage 32 and an outlet passage 34 which are disposed parallel to each other. The first flexible front valve 36 is secured to a projection 38 on the inner wall of the passage 32 by any suitable means (not shown) whereby the valve 36 may move into and out of engagement with the valve seat 40. The outlet passage 34 is provided with a similar flap valve 42 which is secured to a projection 44 by any suitable means (not shown) whereby the valve 42 may move into and out of engagement with the valve seat 46. The two valves 36 and 42 act as one way valves which permit the flow of fluid in the inlet and outlet passages 32 and 34 in the direction of respective arrows.

A piston 50 is mounted for reciprocation within the cylinder 12 and is comprised of a spherical segment cut from a sphere the diameter of which is at least equal to or slightly greater than the internal diameter of the flexible cylinder 12. Thus the piston is provided with a spherical surface 52 which is always disposed in sliding engagement with the cylinder 12 through the full range of tilting movement of the piston within the cylinder as described hereinafter.

A crank plate 54 is connected to a drive shaft 56 for rotation therewith by any suitable connecting means (not shown) such as a key or set screw. The shaft 56 is power driven by any suitable motor (not shown) such as an electric motor or an internal combustion engine. The crank plate is provided with an eccentrically mounted pin 58. One end of a piston rod 60 is rotatably mounted on the pin 58 by a suitable bearing 62 and the opposite end of the piston rod is adjustably threaded into a connector 64 which is rotatably mounted on a pin 66 connected to the piston 50. A suitable bearing 68 is interposed between the connector 64 and the pin 66.

The flexible resilient cylinder 12 may be constructed from polyurethane and the piston 50 may be made of bronze. The cylinder is mounted under tension lengthwise of the cylinder by means of the adjustable bolts 22. After a period of time the tension may be increased on the cylinder by moving the end caps further away from each other to compensate for any wear on the cylinder which has occurred. Thus, the piston is always maintained in fluid tight sealing engagement with the cylinder wall while still permitting reciprocation of the piston relative to the cylinder.

While the invention has been particularly shown and described with reference to a preferred embodiment thereof, it will be understood by those in the art the various changes in form and details may be made therein and without departing from the spirit and scope of the invention.

What is claimed is:

1. A reciprocating piston pump comprising first and second end caps having cylindrical hubs, a flexible resilient cylinder having opposite ends fitted over and secured to said hubs, respectively, inlet and outlet means disposed in said second end cap, adjustable interconnecting means connected between said first and second end caps for adjustable increasing the tension on said cylinder to compensate for wear on the internal surface of the cylinder and piston means having a partial spherical surface disposed in sliding engagement with said cylinder and having a diameter at least equal to an internal diameter of said cylinder.

2. A reciprocating piston pump as set forth in claim 1, wherein said cylinder is constructed of flexible polyurethane and said piston is constructed of bronze.

3. A reciprocating piston pump as set forth in claim 1, wherein said inlet and outlet means are comprised of an inlet passage and an outlet passage extending in parallel within said second end cap a first one way flap valve mounted in said inlet passage to permit the flow of fluid into said cylinder and a second one way flap valve mounted in said outlet passage to permit the flow of fluid out of said cylinder.

4. A reciprocating piston pump as forth in claim 1 further comprising a crank plate having an eccentric pin and adapted to be rotated by drive means, another pin mounted on said piston and a piston rod pivotally connected to each of said pins for imparting a reciprocating movement to said piston within said cylinder.

* * * * *